US011987417B2

(12) United States Patent
Sostmann et al.

(10) Patent No.: US 11,987,417 B2
(45) Date of Patent: May 21, 2024

(54) PLASTIC CONTAINER WITH REINFORCED CORNER PORTIONS

(71) Applicant: GEORG UTZ HOLDING AG, Bremgarten (CH)

(72) Inventors: Rüdiger Sostmann, Lingen (DE); Axel Ritzberger, Altendorf (CH)

(73) Assignee: GEORG UTZ HOLDING AG, Bremgarten (CH)

( * ) Notice: Subject to any disclaimer, the term of this patent is extended or adjusted under 35 U.S.C. 154(b) by 54 days.

(21) Appl. No.: 18/000,469

(22) PCT Filed: Jun. 16, 2021

(86) PCT No.: PCT/IB2021/055295

§ 371 (c)(1),
(2) Date: Dec. 1, 2022

(87) PCT Pub. No.: WO2022/003467

PCT Pub. Date: Jan. 6, 2022

(65) Prior Publication Data

US 2023/0150712 A1 May 18, 2023

(30) Foreign Application Priority Data

Jun. 29, 2020 (CH) ..... 798/20

(51) Int. Cl.
*B65D 1/22* (2006.01)
*B65D 1/40* (2006.01)
(Continued)

(52) U.S. Cl.
CPC ..... *B65D 1/46* (2013.01); *B65D 1/22* (2013.01); *B65D 1/42* (2013.01); *B65D 81/261* (2013.01)

(58) Field of Classification Search
CPC ... B65D 1/40; B65D 1/44; B65D 1/46; B65D 1/48; B65D 1/22; B65D 81/261;
(Continued)

(56) References Cited

U.S. PATENT DOCUMENTS 3,351,228 A * 11/1967 Huisman ..... B65D 1/22 220/607
3,508,679 A * 4/1970 Semple ..... B65D 1/40 220/675

(Continued)

FOREIGN PATENT DOCUMENTS

CH 567 968 A5 10/1975
CH 677090 A5 * 12/1988 ..... B65D 1/22

(Continued)

OTHER PUBLICATIONS

International Search Report mailed on Oct. 7, 2021, in connection with corresponding International Application No. PCT/IB2021/055295 (5 pp., including machine-generated English translation).

*Primary Examiner* — Gideon R Weinerth
(74) *Attorney, Agent, or Firm* — McCormick, Paulding & Huber, PLLC

(57) ABSTRACT

A plastic container (1) with a base (2) and mutually opposite side walls (3, 4) has reinforced corner portions (5) at each of its corners on the outside. The corner portions (5) are of double-walled design, an outer wall (6) extending upwards on the outside in each case from the level of the base (2) over part of the height of the side walls (3, 4). The double-walled corner portions (5) have cavities (7), which extend continuously from top to bottom and are subdivided by one or more ribs (8, 8'). The corner portions (5) formed with the continuous cavities (7) provide advantages in production by injection moulding, the core tools achieving a longer service life thanks to better heat dissipation. When the plastic containers (1) according to the invention are being cleaned
(Continued)

Fig. 5 with water, the continuous cavities (7) allow more hygienic cleaning, the water being able to drain out without any residues being left behind.

4 Claims, 4 Drawing Sheets

(51) Int. Cl.
*B65D 1/42* (2006.01)
*B65D 1/46* (2006.01)
*B65D 81/26* (2006.01)

(58) Field of Classification Search
CPC ..... B65D 21/0209; B65D 21/0213; B65D 21/243; B65D 2501/24152; B65D 2501/2435; B65D 2501/24777; B65D 2501/24808; B65D 2501/2407; B65D 2519/00034; B65D 2519/00069; B65D 2519/00288; B65D 2519/0209; B65D 2519/00174; B65D 2519/00318; B65D 2519/00497; B65D 2519/24777; B65D 2519/00268; Y10S 220/06; Y10S 220/12
USPC ..... 206/511; 220/606, 659, 675
See application file for complete search history.

(56) References Cited

U.S. PATENT DOCUMENTS 3,750,598 A * 8/1973 Campbell ..... B65D 19/0004 16/86 A
3,998,328 A * 12/1976 Box ..... B65D 1/243 220/519
4,249,671 A * 2/1981 Crolli ..... B65D 1/22 220/519
4,386,700 A * 6/1983 Deaton ..... B65D 21/045 220/571
4,597,503 A * 7/1986 Lates ..... B65D 1/22 220/675
4,925,049 A * 5/1990 Przytulla ..... B65D 1/16 220/675
5,397,022 A * 3/1995 Schafer ..... B65D 25/24 220/675
5,862,935 A * 1/1999 Dubois ..... B65D 1/46 220/326
7,637,373 B2 * 12/2009 Stahl ..... B65D 21/0212 206/509
11,528,894 B2 * 12/2022 Oskarsson ..... B65D 21/0213
2003/0183549 A1 * 10/2003 Verna ..... B65D 21/046 206/509
2005/0205454 A1 * 9/2005 McDade ..... B65D 21/0215 206/505
2016/0075479 A1 * 3/2016 Finke ..... B65D 21/045 206/459.5
2021/0229863 A1 * 7/2021 Sostmann ..... B65D 81/261
2023/0174288 A1 * 6/2023 Beckerman ..... B65D 25/2885 220/646
2024/0017905 A1 * 1/2024 Beckerman ..... B65D 1/22
2024/0076114 A1 * 3/2024 Hirz ..... B65D 1/22

FOREIGN PATENT DOCUMENTS

CN 201176285 Y 1/2009
EP 0068576 A1 * 9/1998 ..... B65D 1/22
EP 867113 A2 * 9/1998 ..... A01K 31/002
EP 1882636 A2 1/2008
EP 2 383 190 A1 11/2011
GB 2255968 A * 11/1992 ..... B65D 1/22
NL 2009973 C2 6/2014

* cited by examiner

PLASTIC CONTAINER WITH REINFORCED CORNER PORTIONS

CROSS-REFERENCE TO RELATED APPLICATION

This application is a National Stage application of International Patent Application No. PCT/IB2021/055295, filed Jun. 16, 2021, which claims the priority of Swiss patent application 798/20, filed Jun. 29, 2020, the disclosure of each of which is incorporated herein by reference in its entirety.

TECHNICAL FIELD

The invention relates to a plastic container for transporting and storing goods. In particular, it relates to such a plastic container with reinforced corner portions on the outside of the plastic container.

BACKGROUND OF THE INVENTION

Plastic containers with reinforced corner portions are known. The reinforcement serves to increase the impact resistance of the corners which are exposed in particular to impacts when the containers are moved and stacked.

CH 567 968 discloses a bottle crate with reinforced corner portions consisting of triangle-shaped widenings of corner columns on the inside of the crate which are bevelled towards the base of the crate at an angle of 45° to the side walls.

EP 2 383 190 discloses a plastic container with a reinforced corner portion consisting of a T-shaped rib extending diagonally outwards from the outside of the corners and over the entire height of the container.

In addition, plastic containers are known in the trade which, over part of the height, have a hollow reinforcement on the outside of their corners, which have a small slit-shaped opening at their upper end.

SUMMARY

Accordance to the present invention, a plastic container having a base and side walls extending vertically from the base to a circumferential top edge is disclosed. In each of its corners where the side walls meet, the container has respective reinforced corner portions located in each case on the outside, due to the fact that the corner portions are of double-walled design. For this purpose, an outer wall extends upwards in each case from the level of the lower edge of the side walls over part of the height of the side walls near the outside of the side walls. As such, the double-walled corner portions have cavities extending continuously from top to bottom over the entire height of the double-walled corner portions, with one or more ribs extending in each case from the outer wall to the outside of the side walls. The ribs thus form a plurality of cavities in each corner portion between the outer walls of the corner portions and the side walls of the container. In particular, the hollow corner portions are open at their upper ends as well as at their lower ends.

The design according to the invention of the reinforcing corner portions achieves several advantages in combination, on the one hand during production by injection moulding, and on the other hand during use, in particular during cleaning of the containers. During production, containers of this type are injection moulded in an injection moulding process by means of an injection moulding machine and an injection moulding tool mounted thereon. The moulding tool consists of multiple moulding parts, so that the injection moulded article can also be demoulded after injection and cooling of the plastic.

The moulding tool for the container according to the invention consists of an inner moulding tool part for shaping the inner shape and the upper edge of the container, multiple outer moulding tool parts for each of the outer container side walls and a moulding tool part for the base, at the corners of which protruding tool core elements are integrated. These protruding tool core elements are used to form the cavities of the reinforced, double-walled corner portions of the container in the injection moulding process. In the cycle of the injection moulding process, the moulding elements of the multi-part moulding tool are brought together and pressed against each other at high pressure at the mould partitions (also called pinch-offs). Because the provided cavities of the reinforced corner portions according to the invention are continuous, the elongated protruding tool core elements can be supported at their ends on their full cross-sectional area and over their full circumference on the moulding tool parts for the outer side walls when the moulding tool parts are moved together.

In prior art containers, the openings of the corner portions are slot-shaped, and the core elements are correspondingly small in circumference. In the present invention, however, the support surfaces of the core elements on the moulding tool parts for the side walls are significantly larger than in the prior art. On the one hand, this has the advantage of reducing wear on the costly injection moulding tool parts. This results from the fact that the cooling of the moulding tool parts is increased due to the enlarged surface area when the mould partition is engaged, i.e. when the core elements meet the moulding tool parts of the side walls (also known as pinch off). As a result, the injection moulding tool parts are available over a longer period of use, which makes the overall production of such containers more cost-effective.

On the other hand, the continuous cavities of the corner portions result in a further advantage. When cleaning a plastic container according to the invention by means of water, the containers are washed both on the inside and the outside, wherein the containers are washed upside down, i.e. with the interior facing downwards. Because the cavities of the corner portions are continuous, the washing water can flow directly out of the corner portions without leaving any residue and can be rinsed out completely, and no water is left behind in the cavities. In prior art containers, on the other hand, the cavities are not continuous or are only provided with small openings at the upper end, so that washing water always remains behind and can lead to hygiene problems.

The one or more ribs between the outer walls of the double-walled corner portions and the outsides of the side walls divide the space of the corner portions into several smaller cavities, resulting in an extremely stable structure.

DESCRIPTION OF THE PREFERRED EMBODIMENTS

Figure 1:
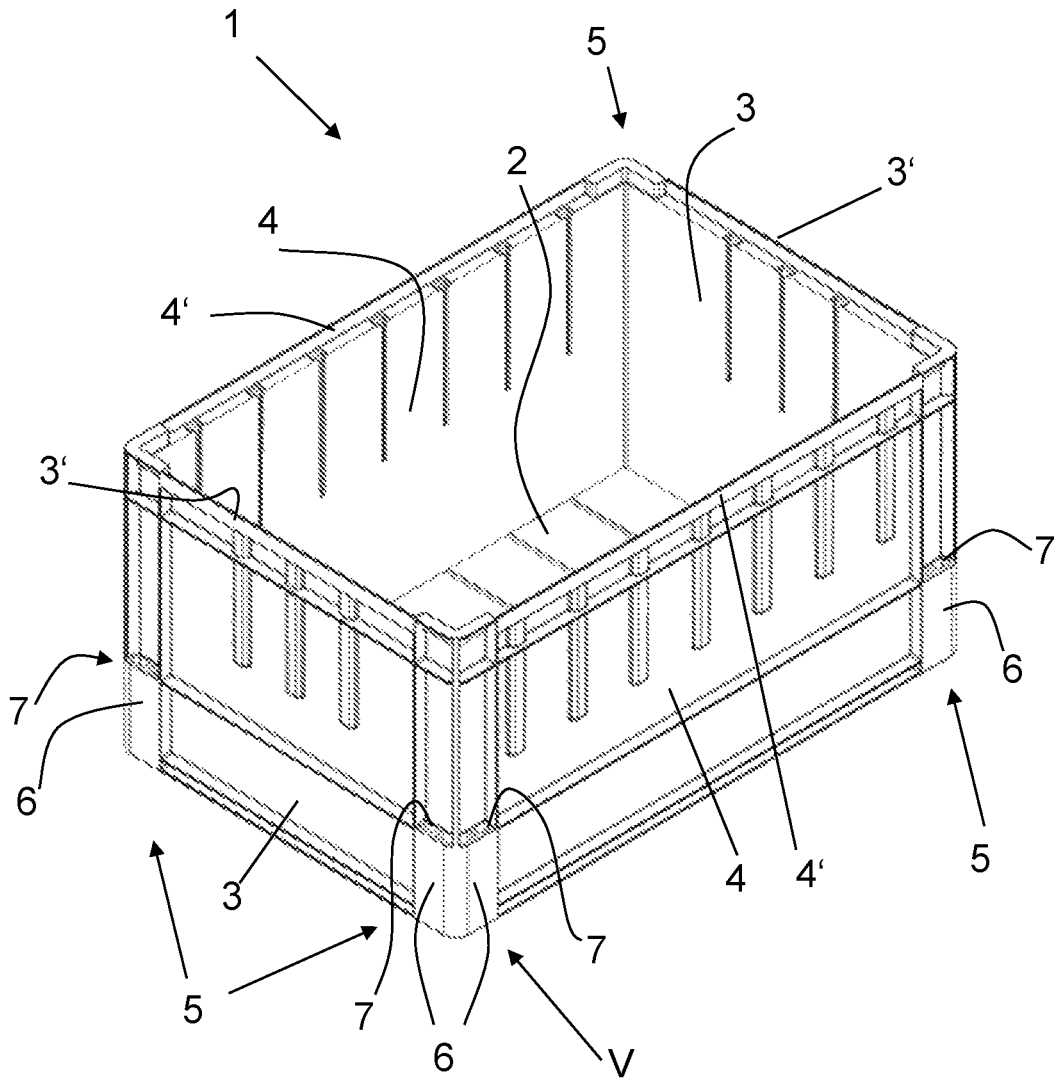
FIG. 1 shows a plastic container according to the invention in perspective from above.

FIG. 1 shows a plastic container 1 according to the invention with a base 2 and short first side walls 3 and long second side walls 4, which extend perpendicular from the base 2 to a respective upper edge 3' and 4', respectively. The first and second side walls 3 and 4 each meet at corners, the corners having reinforcements on their outer sides facing away from the interior of the container. The reinforced corner portions 5 are of double-walled designed for this purpose, the double-walled corners extending from the base to a predetermined height of the corners; however they extend only over a portion of the height of the container rather than to the top of the container. Reinforcement over a portion of the height is generally sufficient for impact resistance of the container.

The double-walled corner portion 5 consists, on the one hand, of the outer wall of the side wall 3 and 4, respectively and, on the other hand, of a second wall 6 which extends over a predetermined height and width. In the view from above according to FIG. 1, in a corner portion 5, cavities 7 are shown in each case between the side walls 3, 4 and the additional outer wall 6. According to the embodiment in FIG. 1, the cavities 7 are designed in particular to be completely open at the top, i.e., they are not reduced in size in any way, but their opening at the upper end has the maximum size.

Figure 2:
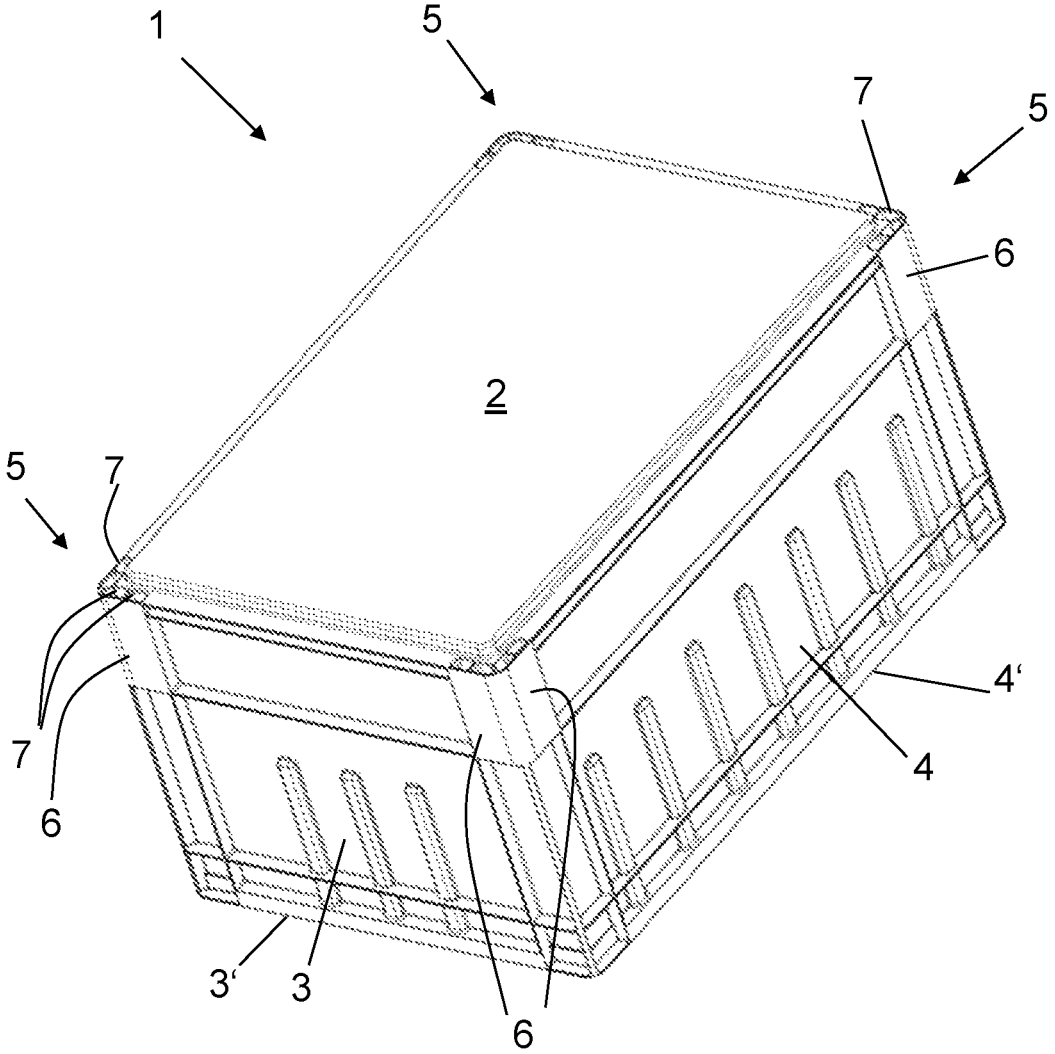
FIG. 2 shows the container from FIG. 1 in perspective from below.

The view from below in FIG. 2 of the same container in turn shows the cavities 7 of the corner portions 5, with the cavities 7 also being open at the bottom. Here, too, the openings have a maximum size at the bottom. The cavities are thus continuous from top to bottom with openings of maximum size.

Figure 3:
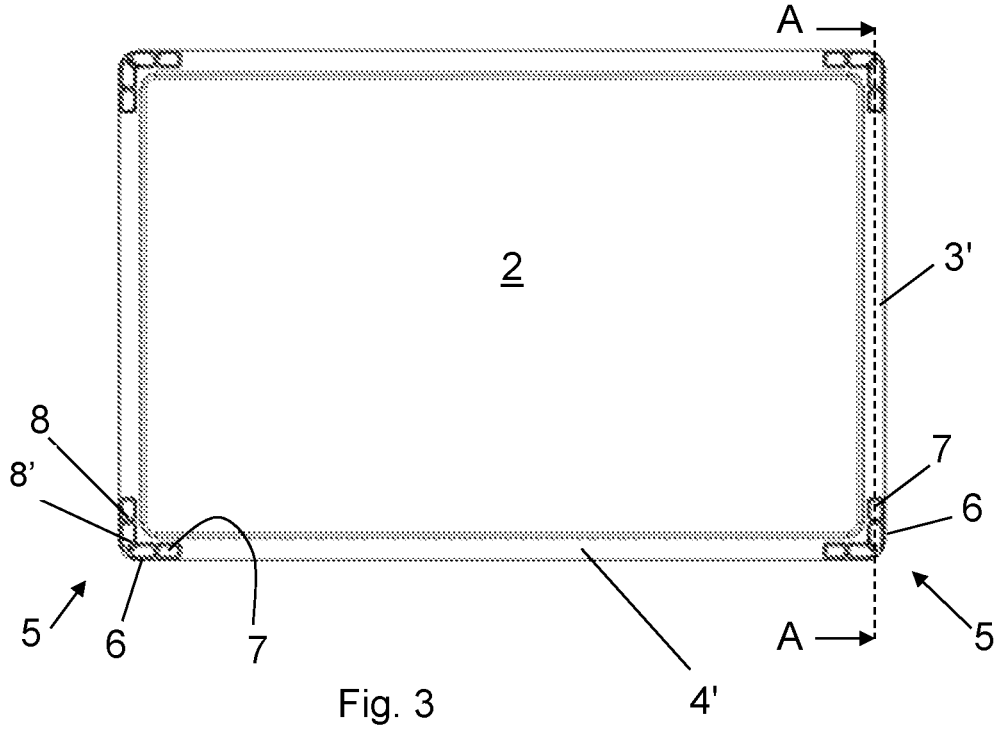
FIG. 3 shows the container from FIGS. 1 and 2 in a top view.

FIG. 3 shows the container in a view from below with the reinforced corner portions 5, each with multiple ribs 8 and 8', which subdivide the corner portions into multiple cavities 7.

Figure 4:
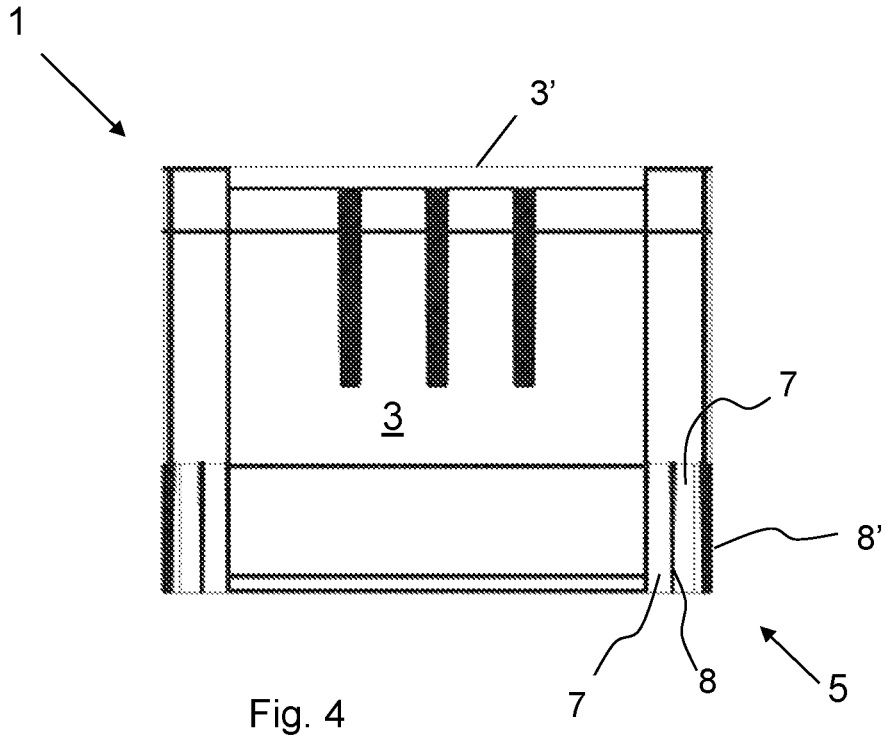
FIG. 4 shows the container from FIG. 3 in cross-section according to A-A in FIG. 3.

FIG. 4 shows the cavities 7 continuously extending from bottom to top in a cross-section according to A-A in FIG. 3. The subdividing ribs 8 and 8' extend over the entire height of the reinforced corner portions 5.

Figure 5:
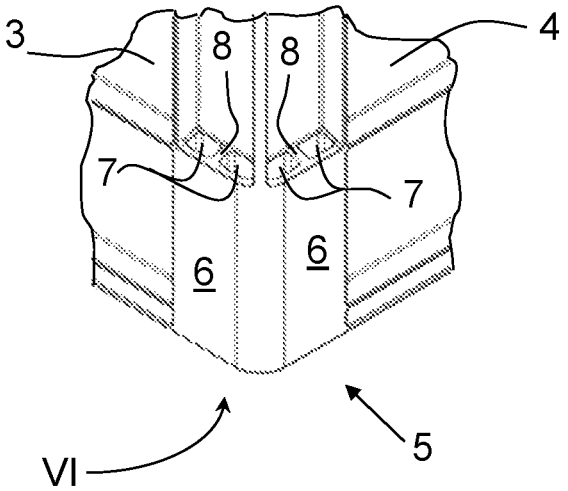
FIG. 5 shows the corner portion according to the invention of the container in an enlarged view from above according to the arrow V in FIG. 1.
Figure 6:
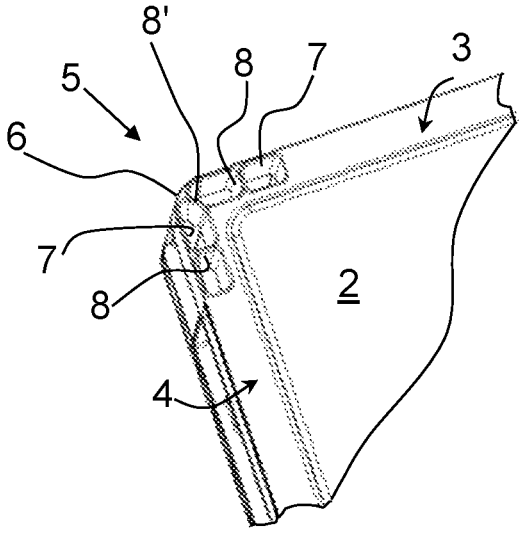
FIG. 6 shows the corner portion from FIG. 5 in an enlarged view from below according to arrow VI in FIG. 5.

FIGS. 5 and 6 show the corner portions in enlarged detail in a perspective view from above and below, respectively. In particular, the lateral ribs 8 on the side walls 3 or 4 are shown, which are at right angles with respect to the side walls 3 or 4 and the walls 6 of the reinforced corner portions. In each corner portion, another rib 8' extends in each case diagonally inwards from the corner of the outer walls 6 to the corner of the container where side walls 3 and 4 meet. The continuous ribs 8 at right angles to the side walls and the diagonal ribs 8' divide the double-walled space of the reinforced corner portions 5 into the multiple continuous cavities 7. FIGS. 5 and 6 also show how each of the ribs 8 and 8' extend over the entire height of the double-walled corner portions, thus optimizing the reinforcement of the corner portions 5.

Although various embodiments of the present invention have been described and shown, the invention is not restricted thereto, but may also be embodied in other ways within the scope of the subject-matter defined in the following claims.

What is claimed is:

1. A plastic container having a base and first side walls and second side walls projecting perpendicularly upwards from the base, the first side walls each being opposite one another and the second side walls each being opposite one another, and the plastic container having corner portions at which the first side walls and the second side walls meet, wherein the corner portions are of double-walled design in that the corner portions each have an outer wall which in each case extends upwards from the lower edge of the side walls over part of the height of the side walls on the outsides thereof, the double-walled corner portions having continuous cavities in that the lower end and the upper end of the corner portions are each designed to be open, the corner portions each having one or more ribs which extend from the outer wall to the outside of the side walls and extend continuously from the lower end to the upper end of the corner portions and form multiple cavities in the corner portions.

2. The plastic container according to claim 1, wherein first ribs are each at right angles to the side walls and lead to the outer walls of the corner portions.

3. The plastic container according to claim 1, wherein second ribs extend diagonally inwards from the corners of the outer walls to the corners where the first side walls and second side walls meet.

4. The plastic container according to claim 2, wherein second ribs extend diagonally inwards from the corners of the outer walls to the corners where the first side walls and second side walls meet.

* * * * *